United States Patent [19]

Buelna

[11] Patent Number: 5,052,349

[45] Date of Patent: Oct. 1, 1991

[54] ROTARY VALVE FOR INTERNAL COMBUSTION ENGINE

[76] Inventor: Terry Buelna, 816 S. Pacific St., Apt. A, Oceanside, Calif. 92054

[21] Appl. No.: 560,372

[22] Filed: Jul. 30, 1990

[51] Int. Cl.[5] ..... F01L 7/00

[52] U.S. Cl. ..... 123/80 BA; 123/190 E; 123/190 DL; 123/190 D; 123/190 BB

[58] Field of Search ..... 123/80 BA, 190 BD, 190 E, 123/190 B, 190 BB, 190 DL; 184/6.16

[56] References Cited

U.S. PATENT DOCUMENTS

| | | | |
|---|---|---|---|
| 2,853,980 | 9/1958 | Zimmerman | 123/41.4 |
| 3,871,340 | 3/1975 | Zimmerman | 123/80 BA |
| 3,943,895 | 3/1976 | Howell | 123/190 D |
| 3,945,364 | 3/1976 | Cook | 123/190 D |
| 4,134,381 | 1/1979 | Little | 123/190 E |
| 4,311,119 | 1/1982 | Menzies | 123/80 BB |
| 4,373,476 | 2/1983 | Vervoordt et al. | 123/190 D |
| 4,597,321 | 7/1986 | Gabelish et al. | 91/470 |
| 4,612,886 | 9/1986 | Hansen et al. | 123/190 D |
| 4,776,306 | 10/1988 | Matsuura et al. | 123/80 R |

OTHER PUBLICATIONS

Cameron, Cycle, 67-71, 87 (May 1990).
Hagen, American Roadracing, 28-31 (Feb., 1990).
Heywood, *Internal Combustion Engine Fundamentals,* 220-229, 342-357 844-853 8/1988.
Miller et al., "Development of a Ceramic Exhaust Part Liner," SAE Paper No. 880677 (1988).
Smith, *Valve Mechanism for High Speed Engines: Their Design and Development,* Ch. 7 (2d end., 1971).
Wilkinson, Autoweek, 17-18, 21-22 (Mar. 12, 1990).
Wilson, Autoweek, 23-25 (Mar. 12, 1990).

*Primary Examiner*—E. Rollins Cross
*Attorney, Agent, or Firm*—Brown, Martin, Haller & McClain

[57] ABSTRACT

The invention herein is a rotary valve apparatus for a cylinder of an internal combustion engine, containing a valve housing having an internal axial bore and an opening over the combustion chamber, a circumferential bearing positioned within the bore, an axially aligned cylindrical valve body journaled in the bearings, at least one axially aligned hollow chamber in the valve body, a drive for rotating the body in correspondence to the operating strokes of the piston in the cylinder, port seals to prevent gas flow around the outer surface of the valve body, and ring seals extending around the inside of the valve housing and sealing with the outer surface of the valve body. A lip seal may also be used on the intake side of the valve. The valve is useful with both two-cycle and four-cycle engines.

30 Claims, 4 Drawing Sheets

ROTARY VALVE FOR INTERNAL COMBUSTION ENGINE

BACKGROUND OF THE INVENTION

1. Field of the Invention

The invention herein relates to flow valves for internal combustion engines. More particularly, it relates to barrel type rotary valves for such engines.

2. Description of the Prior Art

Rotary valves for internal combustion engines have been known for many years. They are classified for two types: a ported disk with its axis parallel to the center line of the cylinder bore or a ported drum or barrel with its axis at right angles to the cylinder. An example of the former is shown in U.S. Pat. No. 4,776,306. The rotary valve of the present invention is an example of the latter type. The two types are distinctly different and are subject to significantly different operating characteristics and problems.

Particular problems arising with barrel type rotary valves include leakage of gas around the outside of the valve. These problems include leakage of gas between intake and exhaust passages (in dual function valves), sealing against gas passage from between adjacent cylinders and efficiency of the combustion (from poor combustion chamber shape and the attendant poor placement of the spark plug) and significant friction losses from the lack of presence of bearings capable of operating in the severe operating environment.

Both two cycle and four cycle internal combustion engines have, of course, also been known for many years. Two cycle engines themselves are divided into two categories, those which have crank case scavenging of the exhaust gases and those which have positive external scavenging. Two cycle engines have the advantage of being smaller and lighter and could, therefore, be advantageously used in small vehicles such as automobiles, light trucks, and motorcycles. However, for the last few years two cycle engines have been incapable of generating sufficient power for vehicular use while simultaneously meeting government vehicle emissions requirements. Consequently, in recent years, spark ignition vehicle engines have been uniformly four cycle engines.

More recently, however, a number of engine and automobile manufacturers have developed and tested several new designs of two cycle engines for vehicles, which engines are described as being of increased power while yet having emission levels low enough to meet government specifications. Consequently, significant interest in the use of two cycle engines for motor vehicles has again developed.

It would, therefore, be very advantageous to have a design of a rotary valve which would be an efficient valve mechanism and would be equally applicable to use with both two cycle and four cycle engines. Such rotary valves would necessarily be much superior to conventional poppet valves in engines, especially in two cycle engines, since poppet valve mechanisms have relatively low operation rates and thus engines have to be slowed down in order for the poppet valves to keep up and operate properly. The rotary valves, however, would be high speed mechanisms and therefore the engines could run at much higher speeds without valve limitations.

SUMMARY OF THE INVENTION

The invention herein is a rotary valve apparatus for a cylinder of an internal combustion engine, the cylinder having therein a piston, with the cylinder and the piston defining a combustion chamber at one end of the cylinder and the combustion chamber having an opening thereinto opposite the piston, the apparatus comprising: a valve housing positioned to cover the opening of the combustion chamber and having a cylindrical bore therein which has a longitudinal axis disposed perpendicularly to (and, to optimize spark plug positioning, preferably offset from) the longitudinal axis of the cylinder, the bore having an open end in fluid communication with either the intake conduit or the exhaust conduit of the engine; circumferential bearing means positioned within the bore; a cylindrical valve body journaled in the bearings and aligned on the axis of the bore, the valve body having an open end corresponding to the open end of the bore; an axially aligned hollow chamber in the valve body, the open end of the bore defining one end of the hollow chamber and a second opening defining the opposite end of the hollow chamber, the hollow chamber extending longitudinally of the valve, with the second opening adapted to be aligned with the opening into the combustion chamber; rotative means for rotating the body within the bore, in correspondence to the operating strokes of the piston in the cylinder and at a constant speed relative to crankshaft speed, and for intermittently aligning the second opening of the hollow chamber with the opening into the combustion chamber such that gaseous material may be passed between the combustion chamber and the intake or exhaust conduit through the hollow chamber; port sealing means disposed in the outer surface of the valve body to prevent gas flow around the outer surface of the valve body; and ring sealing means disposed circumferentially in the inner surface of the bore at each end of the valve body and extending around the inner surface of the bore in sealing contact with the outer surface of the valve body.

The unique valve structures of this invention are useful with both two-cycle and four-cycle engines, but find particularly advantageous use with the latter.

DETAILED DESCRIPTION AND PREFERRED EMBODIMENTS

Figure 2:
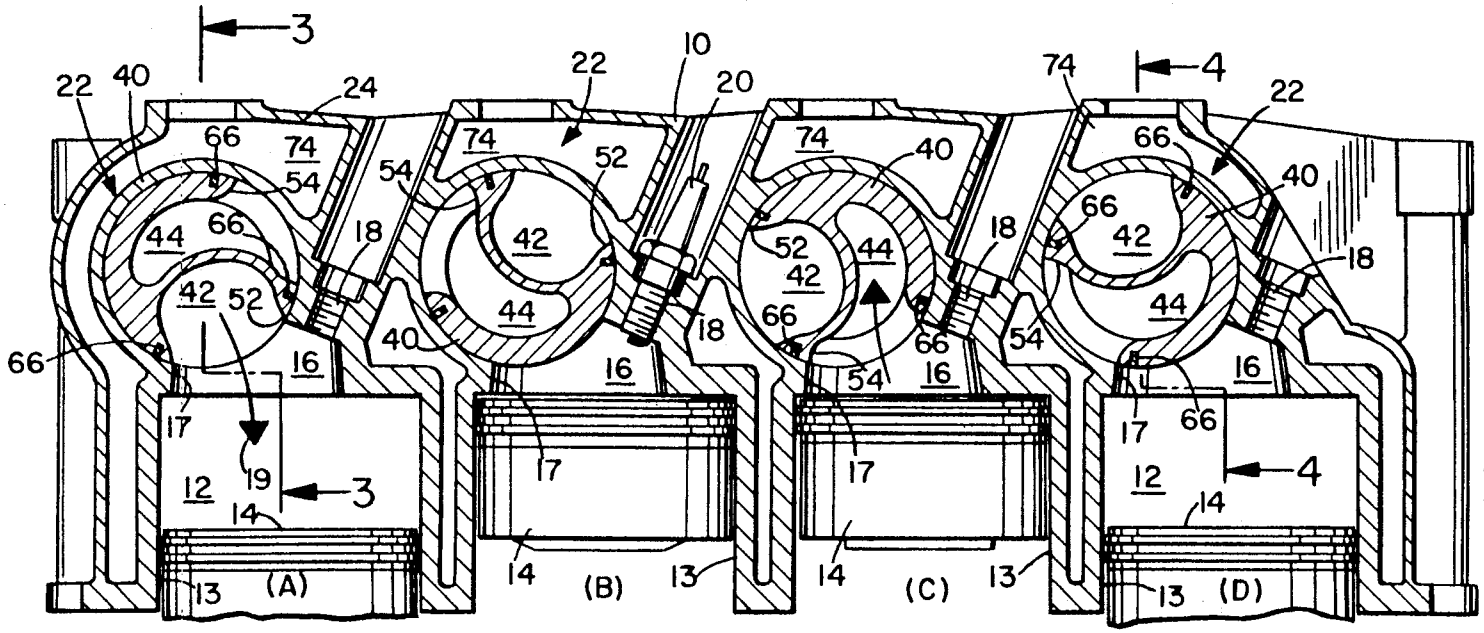
FIG. 2 is a sectional view taken on Line 2—2 of FIG. 1.
Figure 3:
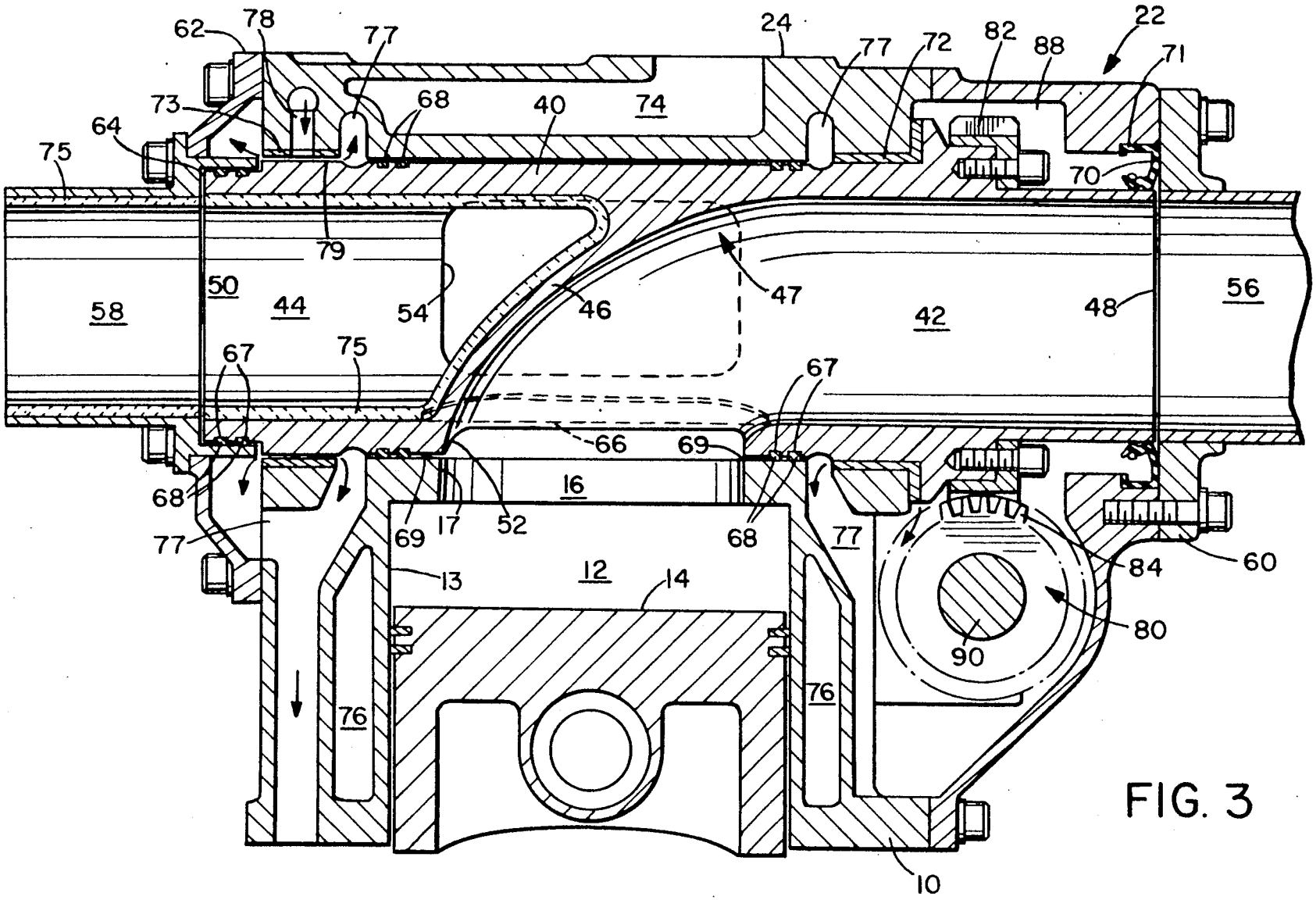
FIG. 3 is an enlarged sectional view taken on Line 3—3 of FIG. 2, showing a bi-function valve and a portion of a four-cycle engine cylinder.
Figure 7:
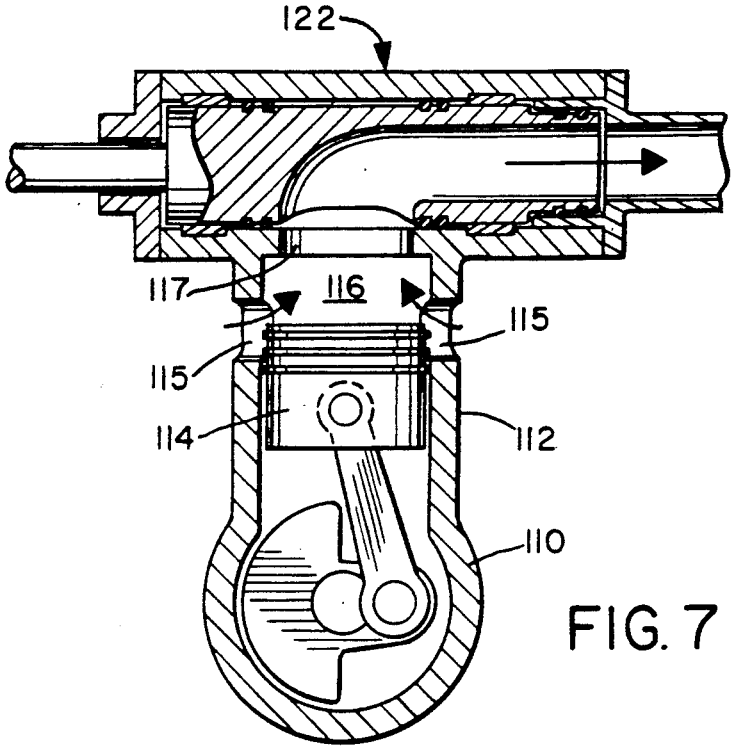
FIG. 7 is a view similar to that of FIG. 3, showing a uni-function valve (functioning as an exhaust valve) and a cylinder of a two-cycle engine.

The invention may be best understood by first considering FIGS. 3 and 7 which show respectively a dual function ("bi-function) valve and a single function ("uni-function") valve of the present invention. The single function valve is shown in use with a two-cycle engine cylinder in which the valve is functioning as the intake valve. It will be evident that it could also be the exhaust valve if the intake and exhaust were reversed. The dual function valve is shown in connection with a four-cycle engine cylinder. FIGS. 1–2 and 4–6 also illustrate a four-cycle multi-cylinder engine, but it will be understood by those skilled in the art that for the most part the descriptions of these Figures will be equally applicable to two-cycle engines and to single-cylinder or single-cylinder-per-cylinder-bank engines (although in the latter, while the valve mechanism would be the same, the drive mechanism would be different). Where there are significant differences they will be noted below.

Considering first the operation of the dual function valve as illustrated in FIGS. 1–6, there is seen an engine block 10 in which are a plurality of cylinders 12 formed by cylinder walls 13 in the block 10 and in which are mounted pistons 14. (For brevity herein only the operation of a single piston and cylinder and the associated valve will be described, except where noted. It will of course be understood that such description is applicable to each of the piston/cylinder/valve combinations in the engine.) Piston 14 and cylinder 10 are conventional in structure, with piston 14 operating in cooperation with a crankshaft through a piston rod (not shown).

Above the top of piston 14 when the piston is in the uppermost (top dead center) position is combustion chamber 16 which has an opening 17 at its top. Extending into combustion chamber 16 through opening 18 is spark plug 20 (only one shown). Mounted opposite opening 18 is the valve of the present invention, generally designated 22. Each cylinder has its own valve 22 which is secured in place by a valve housing 24, a portion of which may be part of the engine block head. Each valve housing 24 is mounted laterally across the top of the cylinder bank, as shown in FIG. 3.

Mounted for axial rotation within the housing 24 is valve body 40 which is generally cylindrical. Formed in valve body 40 are two separate chambers 42 and 44 are structurally isolated from one another by septum 46. Each of the chambers is also generally cylindrical, with one open end (48 or 50 respectively) and terminating in the middle of the valve body 40 with openings 52 and 54 respectively, with each of the chambers 42 and 44 thus having a general shape of an elbow. Openings 52 and 54 are disposed approximately 90° apart circumferentially, although the exact spacing will be determined by the overall engine design. In the embodiment shown, for instance, the openings are 102.5° apart.

The interior shape of the bend 47 in the intake chamber 42 is important to the optimum function of the engine, since it determines the degree of swirl of the intake air or air/fuel mixture, and therefore the efficiency of mixing and ignition. The optimum specific shape of any given bend 47 will be dependent on the size of the intake chamber, the geometry of the combustion chamber, the geometry of the openings 17 and 52, the intake gas flow rate and the degree of performance expected from the engine. Those skilled in the art will be able to determine particular shapes for different applications by routine experimentation based on known rotary valve and engine parameters.

Disposed at either end of the valve body 40 and valve housing 24 are respectively intake conduit 56 and exhaust conduit 58. Commonly each is part of a multi-conduit intake or exhaust manifold, and they will occasionally be referred to as manifolds below. Each manifold 56 or 58 is bolted onto the valve housing 40 by conventional flange means as indicated at 60 and 62 respectively. Appropriate clearance will be provided, such as indicated at 64, particularly on the exhaust side to allow for expansion of the valve body 40 from the heat of the exhaust gases.

There are three important types of seals used in the present invention: piston ring seals, lip seals and port seals. Each will be described in detail below.

Figure 9:
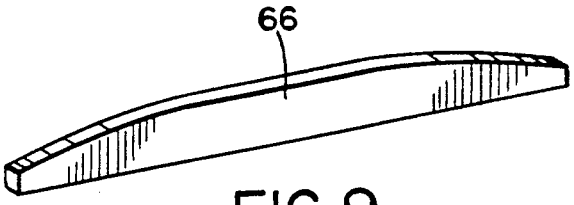
FIG. 9 is a perspective view of a port seal used in the valve of this invention.

The port seals 66 (shown separately in FIG. 9 and shown in position in FIG. 4) are disposed longitudinally of the valve body 40 and serve to seal between the outer surface of the valve body 40 and the inner surface of the valve housing 24. They are designed in generally rectangular form but with the center slightly wider than the ends. This prevents the seal from bulging out at the center and snagging as it passes over the wide port opening 17 in the combustion chamber 16. Advantageously the opening 17 will itself have a semi-elliptical shape as well as radiused edges to help prevent the port seals 66 from snagging. In the dual function valve there will be three port seals 66 while in the uni-function valve there need to be only two port seals 66.

Figure 8:
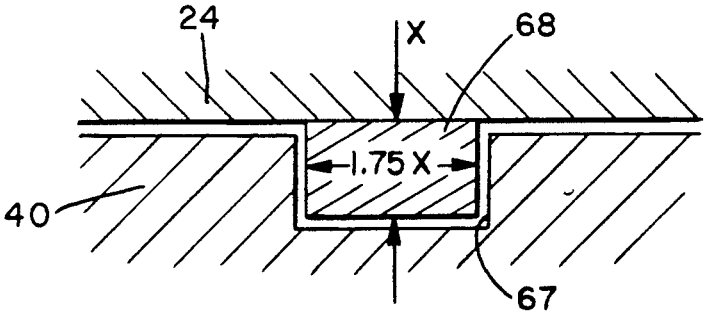
FIG. 8 is a detail view showing a cross-section of a piston ring seal and the groove in which it is fitted.

The second set of seals are the piston ring seals 68 which are seated in circumferential grooves 67 around valve body 40. One or two piston ring seals 68 will be disposed in grooves 67 (as shown in FIG. 8) on opposite sides of the central portion of valve body 40 on either side of the combustion chamber opening 17. These seals 68 prevent the combustion gases, intake air or air/fuel mixture from passing along the side of the valve body 40 in an axial direction. The installed piston ring seals expand outward to contract the inner surface of the static valve housing 24 and upper surface 69 of the cylinder walls 13 and remain static relative to the rotating valve body 40 since they are mounted with a slight clearance on all three sides of the groove 67 in the valve body 40, as shown in FIG. 8. They thus form in effect a labyrinth seal with the rotating valve body 40.

The ring seals 68 are preferably used in conjunction with a positive pressure existing in the intake manifold 56 (as in the case of a supercharged or turbocharged engine) to restrict oil from entering the combustion chamber 16. In a normally aspirated engine, at part throttle operation, the intake manifold pressure will be below crankcase pressure but a sealed crankcase can be used along with a high volume oil scavenge pump to create a crank case pressure below manifold pressure to alleviate the problem of oil working its way into the intake system and the combustion chamber.

Preferably one would use a single ring arrangement so that the journal bearing locations could be moved closer together to minimize bending stresses in the valve body due to combustion chamber gas pressure, as will be described below.

While the particular size of the piston rings 68 will be a matter of routine experimentation or analogy to conventional piston rings on the engine piston 14 itself, I have found that a radial width:ring height ratio of about 1.75 appears to be particularly effective.

Finally, the third type of seal used in the present invention is a spring loaded lip seal 70 which is mounted circumferentially around the valve body 40 at the point where the intake end 48 is adjacent to the intake manifold 52 and flange 60. The seal 70 is mounted in a circumferential groove 71 formed in the inner surface of valve housing 24. This seal prevents the intake charge from leaking into the crankcase. It will be noted, of course, that this seal is used only on the intake side of the valve 40, so it is not used where the valve is a single function valve and is serving as an exhaust valve rather than an intake valve.

The valve body 40 is journaled in bearings 72 and 73 which are mounted on the interior side of the valve housing 24 and upper surface of the cylinder walls 13 on opposite sides of the combustion chamber opening 17. These will normally be pressure fed journal bearings rather than rolling element bearings, since the former are more durable and more resistant to the pulsating gas pressure loads encountered by the valve. Further, they are more compact for given bearing load capacity which allows them to be located close to the combustion chamber 16 and the source of the load. The present invention, however, does not preclude the use of rolling element bearings such as ball bearings or roller bearings.

It will be recognized that the bearing 73 on the exhaust side of the valve is subject to extreme heat, often as much as 1800° F. (1000° C.) from the high temperature exhaust combustion gases from the combustion chamber. Maintaining the strength of the valve material requires that the actual valve temperature kept below about 700°-800° F. (370°-425° C.). Also, if the journal bearing is an automotive type trimetal bearing, the temperature at the outside of the bearing shell must be kept below about 350° F. (176° C.). This can be accomplished in a number of ways, such as having the valve housing 24 and the mounting structure for the journal bearing 73 be cooled by the engine's coolant, running bearings with a large than normal clearance to allow for a greater amount of cooling oil to pass through the bearings, or, most importantly, constructing the valve body 24 with an internal lining in each of the chambers 42 and 44 of a high temperature ceramic 75 of low thermal conductivity such as an yttria stabilized zirconia, commonly called a "partially stabilized zirconia," or aluminum titanate. Ceramics of this type are commonly used in the precombustion chambers of diesel engines to prevent heat transfer. Furthermore, the valve housing 24 and journal bearings can be made heat resistant by fabricating those items from aluminum titanate.

Similarly, and equally important, one should line the interior of the exhaust manifold 58 with the same type of ceramic liner 75, to prevent heat transfer.

The valve body 24 will also contain drain 77 for draining lubricating oil from the journal bearings. The lubricating oil is fed to these bearings under pressure through conduit 78 from an oil pump (not shown) and flows along the clearance passage 79 between the valve housing 24 and the valve body 40. Also present will be coolant channels 74 and 76 which are constructed respectively in the valve housing 24, the cylinder walls 13 and the engine block 10.

Figure 5:
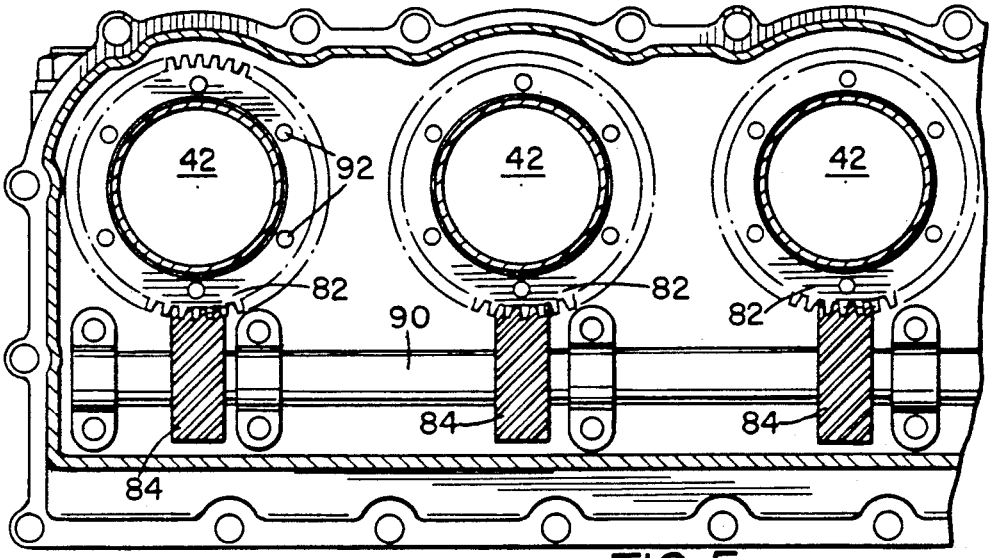
FIG. 5 is a sectional view taken on Line 5—5 of FIG. 4.
Figure 6:
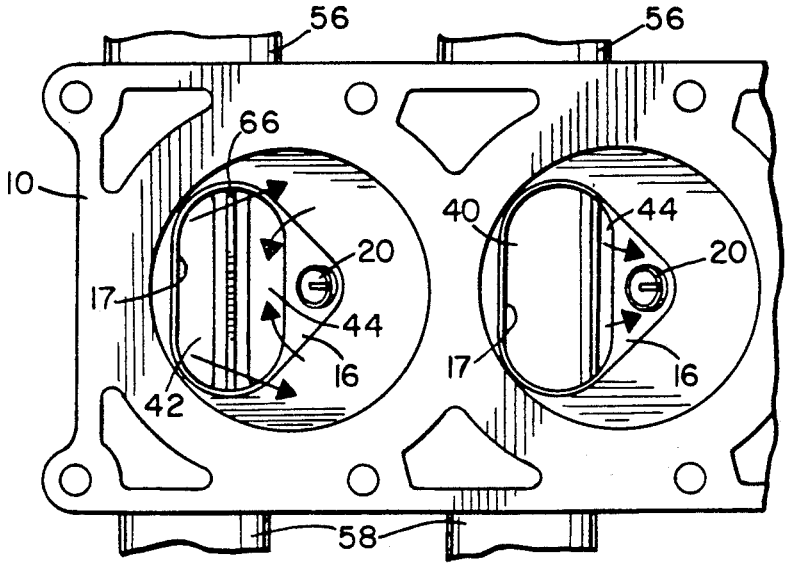
FIG. 6 is a view similar to a portion of FIG. 1, showing specific valve positions.

Valve body 40 will be rotated around its longitudinal axis at a constant speed relative to the crankshaft. Various means can be used to provide the rotative motive, including chain drives or spur gears. In the embodiment shown, the rotative means is a gear set indicated at 80. The gear set as shown in FIGS. 3 and 5 is formed of two crossed helical gears, a circumferential gear 82 mounted on the outside of the valve body 40 and rotating in a clearance space 88 formed in the valve housing 24 and upper side of the engine block 10. The driving gear 84 is mounted on a drive shaft 90 and normally is driven by a belt, gear set or chain (not shown) which connects it to the crankshaft at the front or rear of the engine. Timing adjustment of the gears for precise rotation of the valve body is accomplished by use of phased vernier holes 92. The particular gear ratio used at the crankshaft will depend on whether the engine on which the valve is mounted is a two-cycle or four-cycle engine. A two-cycle engine will normally have a 1:1 total gear ratio since the port 52 must align with the combustion chamber port 17 on each revolution of the crank shaft and stroke of the piston 30, while a four-cycle engine will have a 2:1 ratio since the alignment of the ports 17 and 52 must occur only on every second cycle of the engine (i.e. on the exhaust and intake strokes rather than the compression and power strokes).

The particular shape of the ports 52 will be governed by three factors: providing as large a port opening as possible within the constraints of valve body diameter, proper timing and bore size, providing a port shape conducive to good gas flow in and out of the cylinder and providing an edge contour that allows the port seals to pass smoothly over the edges of the combustion chamber port 17. The port shape will commonly be oval or slightly elliptical, as illustrated in the Figures, but there can be numerous variations depending on the particular engine and engine operating conditions. The exact shape will be readily determined by those skilled in the art for the particular application at hand.

Figure 1:
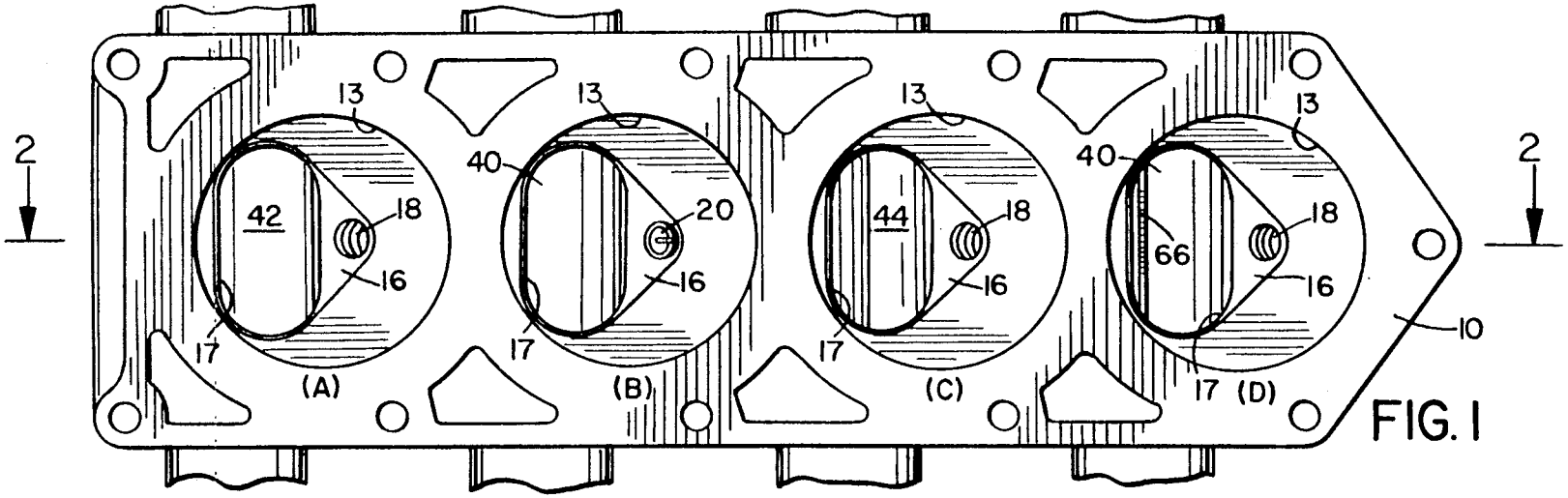
FIG. 1 is a bottom plan view of an engine block of a multi-cylinder engine incorporating the rotary valve assembly of this invention.
Figure 4:
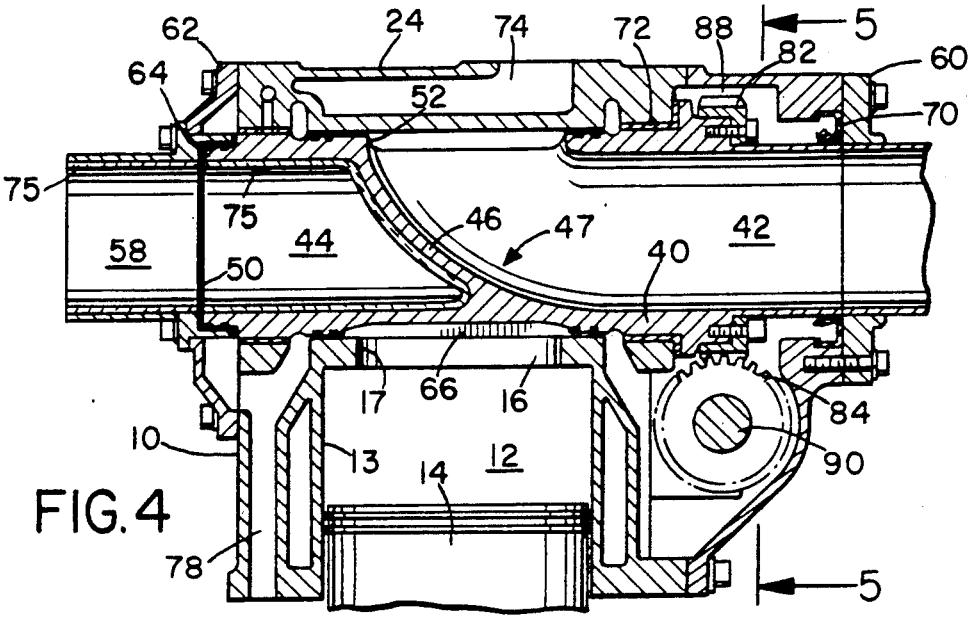
FIG. 4 is a sectional view taken on Line 4—4 of FIG. 2.

A typical engine cycle is illustrated in FIGS. 1 and 2, designating the cylinders as A, B, C and D from left to right in the Figures. Cylinder A is shown in an intake stroke, in which the valve body 40 is turned so that openings 17 and 52 are aligned and an air/fuel mixture is entering combustion chamber 16 as indicated by the arrow 19. Piston 14 is descending so that the air/fuel mixture will be drawn into the cylinder 12. Cylinder B is shown in the compression stroke, with valve 22 rotated approximately 90° to present a solid side to opening 17 and close combustion chamber 16. Piston 14 is shown at the top of its ascent, at or approaching top dead center (TDC). The air/fuel mixture is essentially fully compressed. Timing of the firing of spark plug 20 may come at top dead center but usually occurs before TDC, sometimes as much as 50°-60° before TDC. Cylinder D shows the power stroke, after the spark plug has fired. Valve 22 has rotated approximately another 90° but still presents a solid side to opening 17 so that combustion chamber 16 remains closed so that the ignited expanding air/fuel mixture can drive piston 14 downward in its power stroke. Finally, cylinder C is in the exhaust stroke, where piston 14 is ascending and is sweeping the combustion gases out of the cylinder 13 and combustion chamber 16 through exhaust chamber 44 of valve 40. The valve 40 has rotated approximately another 90° so that opening 54 is now aligned with opening 17. (FIG. 4 shows the valve at a point in its rotation slightly past the position shown for cylinder B in FIGS. 1 and 2.)

FIG. 7 illustrates a uni-function valve 122 of this invention with a two-cycle engine. There is shown a cylinder 112 in which moves a piston 114 and in which there is a combustion chamber 116 and a port 117. Gas ports 115 are formed through engine block 110 in a location such that as the piston 114 reaches the top of its stroke it seals off the ports 115 and forms combustion chamber 116 in the top portion of the cylinder 112. The air/fuel mixture is ignited by a conventional spark plug (not shown) to drive the piston 114 downward in a power stroke, again uncovering the ports 115.

In the particular embodiment shown in FIG. 7, the valve 122 serves as the intake valve of the combustion chamber 116 and the ports 115 serve as the exhaust ports. The air coming into the intake can be through a conventional crankcase scavenged source or can be connected to a positive external air blower; both are commonly used, although the positive external scavenging is preferred for better emissions control.

The intake can provide the air alone with the fuel being separately injected or it can provide an air/fuel mixture, both as commonly practiced.

It will also be evident that functions of the uni-function valve could be reversed so that the valve 122 serves as the exhaust valve of combustion chamber 116 and the ports 115 served as the intake valves as is conventional in some two-cycle engines. With respect to the present invention, the valve structure would be substantially the same, except that provision would have to be made for the much higher temperatures of the exhaust gases, as discussed above.

It will be evident that there are numerous embodiments of this invention which, while not expressly described above, are clearly within the scope and spirit of the invention. The above description is therefore to be considered exemplary only, and the actual scope of the invention is to be determined solely from the appended claims.

I claim:

1. Rotary valve apparatus for a cylinder of an internal combustion engine, said cylinder having therein a piston, with said cylinder and said piston defining a combustion chamber at one end of said cylinder and said combustion chamber having an opening thereinto opposite said piston, said apparatus comprising:

a valve housing positioned to cover said opening of said combustion chamber and having a cylindrical bore therein which has a longitudinal axis disposed perpendicularly to the longitudinal axis of said cylinder, said bore having an open end in fluid communication with either the intake conduit or the exhaust conduit of said engine;

circumferential bearing means positioned within said bore;

a cylindrical valve body journaled in said bearings and aligned on said axis of said bore, said valve body having an open end corresponding to said open end of said bore;

an axially aligned hollow chamber in said valve body, said open end of said bore defining one end of said hollow chamber and a second opening defining the opposite end of said hollow chamber, said hollow chamber extending longitudinally of said valve, with said second opening adapted to be aligned with said opening into said combustion chamber;

rotative means for rotating said body within said bore, in correspondence to the operating strokes of said piston in said cylinder and at a constant speed relative to crankshaft speed, and for intermittently aligning said second opening of said hollow chamber with said opening into said combustion chamber such that gaseous material may be passed between said combustion chamber and said intake or exhaust conduit through said hollow chamber;

port sealing means disposed in the outer surface of said valve body to prevent gas flow around said outer surface of said valve body; and ring sealing means disposed circumferentially in the inner surface of said bore at each end of said valve body and extending around said inner surface of said bore in sealing contact with the outer surface of said valve body.

2. Rotary valve apparatus as in claim 1, further comprising means in said hollow chamber to cause intake gases to swirl upon entry into said combustion chamber.

3. Rotary valve apparatus as in claim 1, wherein said rotative means comprises a ring gear circumferentially surrounding said valve body and a mating drive gear.

4. Rotary valve apparatus as in claim 3, wherein said drive gear is mounted on a drive shaft which is driven by the engine crankshaft.

5. Rotary valve apparatus as in claim 3, wherein said gears are crossed helical gears.

6. Rotary valve apparatus as in claim 1, further comprising means for simultaneously cooling and lubricating said valve body.

7. Rotary valve apparatus as in claim 1, further comprising a heat resistant liner on the interior of at least some surfaces exposed to exhaust gases from said combustion chamber.

8. Rotary valve apparatus as in claim 7, wherein said heat resistant liner comprises a ceramic material of low thermal conductivity.

9. Rotary valve apparatus as in claim 8, wherein said ceramic material is a partially stabilized zirconia or aluminum titanate.

10. Rotary valve apparatus as in claim 1 wherein said cylindrical bore of said valve housing has a longitudinal axis disposed perpendicularly to and offset from the longitudinal axis of said cylinder.

11. Rotary valve apparatus as in claim 1, wherein said internal combustion engine is a four-cycle engine, further comprising:

said cylindrical bore extending axially through said valve housing and having an open intake end and an open exhaust end, said bore being in fluid communication at its opposite intake and exhaust ends respectively with the intake conduit and the exhaust conduit of said engine;

said valve body also having an open intake end and an open exhaust end at the opposite ends of its axis, each corresponding respectively to the open intake and exhaust ends of said bore;

two axially aligned hollow chambers in said body, said open intake end of said valve body defining one end of the first hollow chamber and said open exhaust end defining one end of the second hollow chamber, with each chamber extending longitudinally of said body and each having a second opening adapted to be aligned with said opening into said combustion chamber, with said second opening of said first chamber and said second opening of said second chamber being positioned approximately 90° apart radially of said body, and said chambers having a gas impermeable barrier therebetween;

said rotative rotational increments being approximately 90° in correspondence to the operating strokes of the four-cycle piston in said cylinder;

said rotative means also separately aligning said respective second openings with said opening into said combustion chamber such that alternately a gaseous air/fuel may be passed into said combustion chamber and gaseous combustion products may be exhausted from said combustion chamber;

high temperature resistant liner means positioned at said exhaust end of said valve body and extending into said exhaust conduit of said engine; and lip sealing means disposed circumferentially around said outer surface of said valve body at said intake end thereof and in sealing contact with said intake conduit of said engine.

12. Rotary valve apparatus as in claim 11, further comprising means in said first hollow chamber to cause intake gases to swirl upon entry into said combustion chamber.

13. Rotary valve apparatus as in claim 11, wherein said rotative means comprises a ring gear circumferentially surrounding said valve body and a mating drive gear.

14. Rotary valve apparatus as in claim 13, wherein said drive gear is mounted on a drive shaft which is driven by the engine crankshaft.

15. Rotary valve apparatus as in claim 13, wherein said gears are crossed helical gears.

16. Rotary valve apparatus as in claim 11, further comprising means for simultaneously cooling and lubricating said valve body.

17. Rotary valve apparatus as in claim 11, further comprising a heat resistant liner on the interior of at least some surfaces exposed to exhaust gases from said combustion chamber.

18. Rotary valve apparatus as in claim 17, wherein said heat resistant liner comprises a ceramic material of low thermal conductivity.

19. Rotary valve apparatus as in claim 18, wherein said ceramic material is a partially stabilized zirconia or aluminum titanate.

20. Rotary valve apparatus as in claim 11 wherein said cylindrical bore of said valve housing has a longitudinal axis disposed perpendicularly to and offset from the longitudinal axis of said cylinder.

21. Rotary valve apparatus as in claim 1, wherein said internal combustion engine is a two-cycle engine, further comprising:

said bore of said valve housing having its open end in fluid communication with the intake conduit of said engine; and said rotational increment being approximately 180° to correspond with the operating strokes of the two-cycle piston in said cylinder.

22. Rotary valve apparatus as in claim 21, further comprising means in said hollow chamber to cause intake gases to swirl upon entry into said combustion chamber.

23. Rotary valve apparatus as in claim 21, wherein said rotative means comprises a ring gear circumferentially surrounding said valve body and a mating drive gear.

24. Rotary valve apparatus as in claim 23, wherein said drive gear is mounted on a drive shaft which is driven by the engine crankshaft.

25. Rotary valve apparatus as in claim 23, wherein said gears are crossed helical gears.

26. Rotary valve apparatus as in claim 21, further comprising means for simultaneously cooling and lubricating said valve body.

27. Rotary valve apparatus as in claim 21, further comprising a heat resistant liner on the interior of at least some surfaces exposed to exhaust gases from said combustion chamber.

28. Rotary valve apparatus as in claim 26, wherein said heat resistant liner comprises a ceramic material of low thermal conductivity.

29. Rotary valve apparatus as in claim 28, wherein said ceramic material is a partially stabilized zirconia or aluminum titanate.

30. Rotary valve apparatus as in claim 21 wherein said cylindrical bore of said valve housing has a longitudinal axis disposed perpendicularly to and offset from the longitudinal axis of said cylinder.

* * * * *